US011597616B2

(12) United States Patent
Fukasawa et al.

(10) Patent No.: US 11,597,616 B2
(45) Date of Patent: Mar. 7, 2023

(54) FEEDING DEVICE AND IMAGE FORMING APPARATUS

(71) Applicants: Hikaru Fukasawa, Kanagawa (JP); Hidetoshi Kojima, Kanagawa (JP); Tatsuya Sugawara, Kanagawa (JP); Takashi Nakano, Kanagawa (JP); Atsunori Yoshida, Kanagawa (JP)

(72) Inventors: Hikaru Fukasawa, Kanagawa (JP); Hidetoshi Kojima, Kanagawa (JP); Tatsuya Sugawara, Kanagawa (JP); Takashi Nakano, Kanagawa (JP); Atsunori Yoshida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 65 days.

(21) Appl. No.: 17/204,002

(22) Filed: Mar. 17, 2021

(65) Prior Publication Data

US 2021/0292118 A1 Sep. 23, 2021

(30) Foreign Application Priority Data

Mar. 19, 2020 (JP) ..... JP2020-048572

(51) Int. Cl.
*B65H 1/18* (2006.01)
*B65H 7/14* (2006.01)
(Continued)

(52) U.S. Cl.
CPC ..... *B65H 1/18* (2013.01); *B65H 1/14* (2013.01); *B65H 3/128* (2013.01); *B65H 3/48* (2013.01);
(Continued)

(58) Field of Classification Search
CPC . B65H 1/14; B65H 1/18; B65H 3/047; B65H 3/128; B65H 3/48; B65H 7/02;
(Continued)

(56) References Cited

U.S. PATENT DOCUMENTS 7,267,337 B2 * 9/2007 Moore ..... B65H 7/14 271/148
11,230,451 B2 * 1/2022 Bhaskaran ..... B65H 7/02
(Continued)

FOREIGN PATENT DOCUMENTS

JP 2011-225307 11/2011
JP 2019-119605 7/2019

*Primary Examiner* — Prasad V Gokhale
(74) *Attorney, Agent, or Firm* — Harness, Dickey & Pierce, P.L.C.

(57) ABSTRACT

A feeding device includes a loading portion, a lifting mechanism, a conveying unit, a sheet detector, a near-end detector, and process circuitry. The loading portion stacks a plurality of sheets. The lifting mechanism lifts the loading portion. The conveying unit conveys the sheets on the loading portion. The sheet detector detects presence or absence of the sheets on the loading portion at a specified height position. The sheet count detector detects a number of sheets conveyed by the conveying unit. The near-end detector detects a near-end state in which a stack height of the sheets on the loading portion is a specified value or less. The process circuitry controls the lifting mechanism based on a detection result of the sheet detector before the near-end state is detected, and controls the lifting mechanism based on a detection result of the sheet count detector after the near-end state is detected.

16 Claims, 8 Drawing Sheets

(51) Int. Cl.

| | |
|---|---|
| ***B65H 1/14*** | (2006.01) |
| ***B65H 3/12*** | (2006.01) |
| ***B65H 7/04*** | (2006.01) |
| ***B65H 3/48*** | (2006.01) |
| *G03G 15/00* | (2006.01) |

(52) U.S. Cl.
CPC ..... *B65H 7/04* (2013.01); *B65H 7/14* (2013.01); *B65H 2511/15* (2013.01); *G03G 15/6511* (2013.01)

(58) Field of Classification Search
CPC ..... B65H 7/04; B65H 7/14; B65H 2511/15; B65H 2511/152
See application file for complete search history.

(56) References Cited

U.S. PATENT DOCUMENTS

| | | | | |
|---|---|---|---|---|
| 2007/0228639 | A1* | 10/2007 | Matsumoto | B65H 1/14 271/97 |
| 2008/0079216 | A1* | 4/2008 | Fuchi | B65H 1/14 399/362 |
| 2010/0225047 | A1* | 9/2010 | Yoshimura | G03G 15/553 271/9.07 |
| 2015/0166280 | A1* | 6/2015 | Hino | B65H 1/14 271/11 |
| 2016/0122144 | A1 | 5/2016 | Fukumoto et al. | |
| 2016/0212278 | A1* | 7/2016 | Yamazaki | H04N 1/32657 |
| 2017/0160689 | A1 | 6/2017 | Sugawara et al. | |
| 2017/0174458 | A1 | 6/2017 | Takano et al. | |
| 2017/0327329 | A1 | 11/2017 | Takahashi et al. | |
| 2018/0237239 | A1 | 8/2018 | Okutsu et al. | |
| 2019/0202647 | A1* | 7/2019 | Sugawara | B65H 1/14 |
| 2019/0210821 | A1 | 7/2019 | Edo et al. | |

* cited by examiner

FEEDING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-048572, filed on Mar. 19, 2020, in the Japan Patent Office, the entire disclosure of which is incorporated by reference herein.

BACKGROUND

Technical Field

Aspects of the present disclosure relate to a feeding device and an image forming apparatus.

Related Art

Various image forming apparatuses such as copiers, printers, and printing machines include a feeding device that feeds sheets such as paper sheets. Such a feeding device is known to employ an air suction method using a suction device. For example, by performing the air suction method in the above-described feeding device, air is blown from a blower device toward a bundle of sheets loaded on a loading portion (such as a bottom plate). The uppermost sheet blown by the blower device is lifted and attracted by a suction device. While the uppermost sheet is being attracted by the suction device, a sheet transfer belt conveys the uppermost sheet in a sheet feeding direction.

SUMMARY

In an aspect of the present disclosure, there is provided a feeding device that includes a loading portion, a lifting mechanism, a conveying unit, a sheet detector, a near-end detector, and process circuitry. The loading portion stacks a plurality of sheets. The lifting mechanism lifts the loading portion. The conveying unit conveys the sheets on the loading portion. The sheet detector detects presence or absence of the sheets on the loading portion at a specified height position. The sheet count detector detects a number of sheets conveyed by the conveying unit. The near-end detector detects a near-end state in which a stack height of the sheets on the loading portion is a specified value or less. The process circuitry controls the lifting mechanism based on a detection result of the sheet detector before the near-end state is detected, and controls the lifting mechanism based on a detection result of the sheet count detector after the near-end state is detected.

In another aspect of the present disclosure, there is provided an image forming apparatus that includes the feeding device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
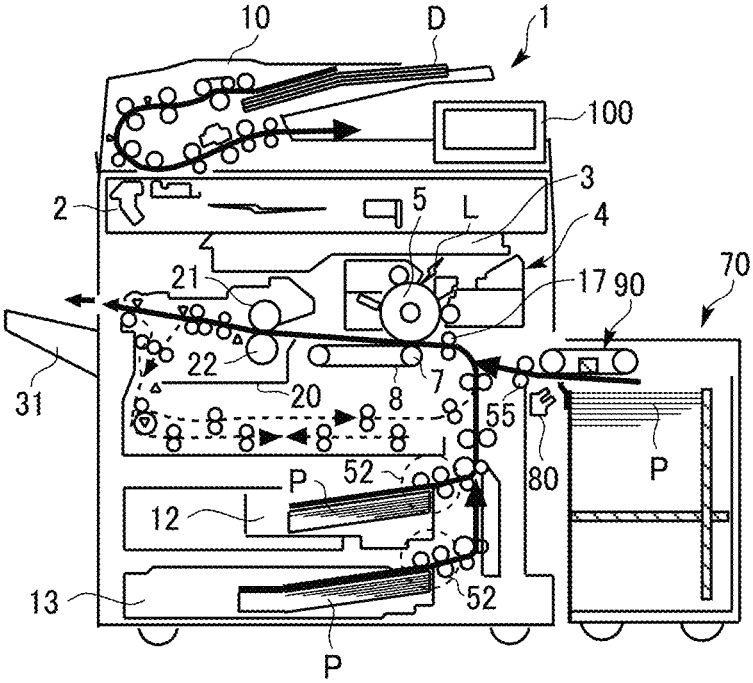
FIG. 1 is a schematic view of an overall configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

An overall configuration and operation of an image forming apparatus 1 according to an embodiment of the present disclosure are described below with reference to FIG. 1. In FIG. 1, the image forming apparatus 1 according to the present embodiment is illustrated as a copier. A scanner 2 (as a document reading device) optically reads image data of an original document D. An exposure device 3 emits exposure light L based on image data read by the scanner 2 to irradiate the exposure light L onto a surface of a photoconductive drum 5. An image forming device 4 forms a toner image on the surface of the photoconductive drum 5. A transfer roller 7 contacts the photoconductive drum 5 via a transfer conveying belt 8 to form a transfer nip region. The transfer conveying belt 8 transfers the toner image formed on the photoconductive drum 5 onto a sheet P and conveys the sheet P with the toner image. A document feeder 10 as an auto-document feeder (ADF) conveys the original document D set on a document tray to the scanner 2. An upper sheet feed tray 12 and a lower sheet feed tray 13 are sheet feed trays (as feeding devices), each of which contains the sheet P (as a recording medium). A pair of registration rollers 17 (in other words, a pair of timing rollers) conveys the sheet P toward the transfer nip region. A fixing device 20 fixes a toner image (unfixed image) borne on the sheet P. A fixing roller 21 is installed on the fixing device 20. A pressure roller 22 is installed on the fixing device 20. An ejection tray 31 receives a sheet P ejected from an apparatus body of the image forming apparatus 1. A feeding device 70 (as a large-capacity feeding device) stores a large capacity of sheets P. An operation display panel 100 displays various types of information and operation buttons for performing various operations.

A normal image forming operation of the image forming apparatus 1 is described below with reference to FIG. 1. A plurality of conveying roller pairs of the document feeder 10 conveys a document D from a document tray in a direction indicated by an arrow in FIG. 1. The document D thus conveyed passes over the scanner 2. At this time, the scanner 2 optically scans the document D passing over the scanner 2 to read image data. The image data optically read by the scanner 2 is converted into electrical signals. The electrical signals are transmitted to the exposure device 3 serving as a writer. The exposure device 3 then emits exposure light L, such as laser light, according to the electrical signals (i.e., image data) toward the surface of the photoconductive drum 5 disposed in the image forming device 4.

The photoconductive drum 5 of the image forming device 4 rotates in a clockwise direction in FIG. 1. After a series of specified image forming processes (e.g., a charging process, an exposing process, and a developing process) is completed, a toner image corresponding to the image data is formed on the surface of the photoconductive drum 5. Then, the toner image formed on the surface of the photoconductive drum 5 is transferred onto the sheet P that is conveyed by the pair of registration rollers 17, in the transfer nip region (i.e., a position at which the transfer roller 7 contacts the photoconductive drum 5 via the transfer conveying belt 8).

Now, a description is given of how to operate the sheet P conveyed to the transfer nip region. As illustrated in FIG. 1, one sheet feed tray of the upper sheet feed tray 12 and the lower sheet feed tray 13 of the image forming apparatus 1 is selected automatically or manually (for example, in the operations according to the present embodiment of this disclosure, the upper sheet feed tray 12 that is an uppermost sheet tray is assumed to be selected). When the upper sheet feed tray 12 of the image forming apparatus 1 is selected, an uppermost sheet P contained in the upper sheet feed tray 12 is fed by a sheet feeding mechanism 52 toward a sheet conveyance passage. The sheet feeding mechanism 52 includes a sheet feed roller, a pickup roller, a backup roller, and so forth. Thereafter, the uppermost sheet P passes through the sheet conveyance passage, in which a plurality of conveying roller pairs are disposed, and then reaches the pair of registration rollers 17. It is to be noted that, when the feeding device 70 that contains a large capacity of sheets (as the large-capacity feeding device) disposed at one side of the apparatus body of the image forming apparatus 1 is selected, an uppermost sheet P placed on top of a sheet bundle of multiple sheets loaded on a loading portion 72 (see FIG. 2) of the feeding device 70 is fed by a conveying belt 91 of a conveying device 90 into the sheet conveyance passage where a pair of conveying rollers 55 is disposed, eventually reaching the pair of registration rollers 17.

After reaching the pair of registration rollers 17, the uppermost sheet P is conveyed toward the transfer nip region in synchronization with movement of the toner image formed on the surface of the photoconductive drum 5 for positioning. After completion of a transfer process, the uppermost sheet P passes the position of the transfer nip region while being conveyed by the transfer conveying belt 8, and then reaches the fixing device 20. In the fixing device 20, the uppermost sheet P is conveyed between the fixing roller 21 and the pressure roller 22, so that the toner image is fixed to the sheet P under heat applied by the fixing roller 21 and pressure applied by the fixing roller 21 and the pressure roller 22, which is a fixing process. The sheet P with the toner fixed thereto after the fixing process passes a fixing nip region formed between the fixing roller 21 and the pressure roller 22. Then, the sheet P is ejected from the apparatus body of the image forming apparatus 1. After having been ejected from the apparatus body of the image forming apparatus 1, the sheet P is stacked as an output image, on the ejection tray 31. Accordingly, a series of image forming processes is completed.

Figure 2:
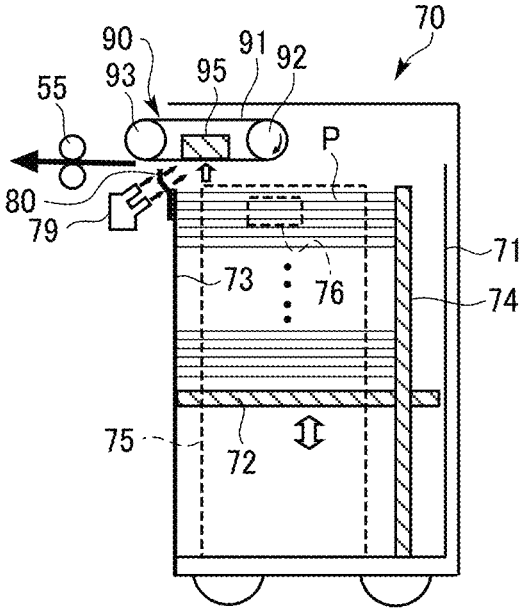
FIG. 2 is a schematic view of a feeding device according to an embodiment of the present disclosure.

Next, a detailed description is given of the feeding device 70 (as the large-capacity feeding device) according to the present embodiment of this disclosure. Referring to FIGS. 2 and 3, the feeding device 70 is to feed the sheet P in a specified sheet feeding direction, as indicated by arrow in FIG. 2, and includes a sheet container 71, a conveying device 90, blower devices 76 and 79, and so forth. The sheet container 71 includes the loading portion 72 (as a bottom plate), a reference fence 73, a regulating plate 80, an end fence 74, side fences 75, and so forth. The conveying device 90 includes the conveying belt 91 as a conveyor that is extended and supported between two rollers (i.e., a drive roller 93 and a driven roller 92), a suction device 95, and so forth. The control of a motor 97 (see FIG. 4) by a controller 60 causes the drive roller 93 to rotate in the clockwise direction in FIG. 2. As a result, the conveying belt 91 is driven to travel in the clockwise direction. With this configuration, the sheet P contained in the sheet container 71 is fed by the conveying device 90 in the sheet feeding direction indicated by arrow in FIGS. 2 and 3D.

To be more specific, the reference fence 73 is formed so as to upwardly stand in a vertical direction on a downstream side of the sheet container 71 (or the loading portion 72) in the sheet conveyance direction. The loading portion 72 is formed so as to load multiple sheets P in a state in which the multiple sheets P remain in contact with the reference fence 73. Further, the loading portion 72 is vertically movable such that an uppermost sheet P1 is located at a specified position in height even though the number of sheets P stacked on the loading portion 72 varies. The specified position in height of the uppermost sheet P1 corresponds to the position depicted in FIGS. 3A and 5A and is detected by a height sensor 62 as a sheet detector illustrated in FIGS. 5A to 5C. That is, the loading portion 72 is to stack multiple sheets P. A lifting mechanism 110 (see FIG. 4) lifts up and down in the vertical direction, which is indicated by a white two-headed arrow in FIG. 2, along the reference fence 73, according to the height of the stacked sheets P (height of sheets stacked) on the loading portion 72.

Figure 4:
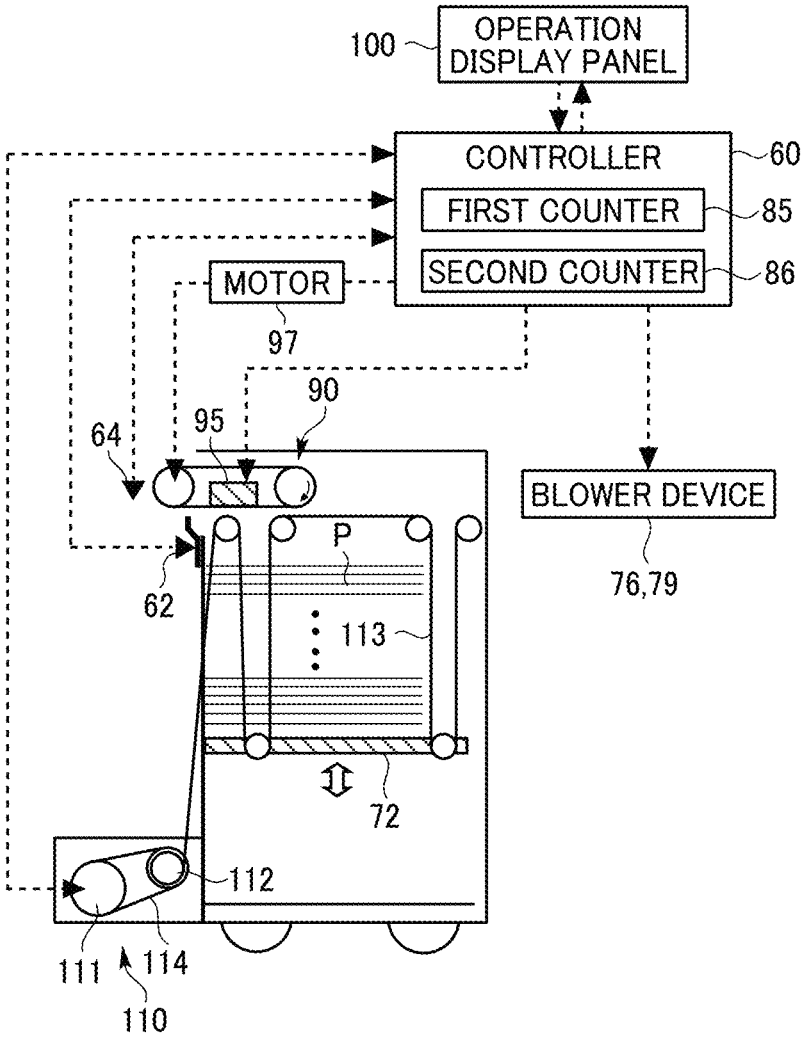
FIG. 4 is a schematic view illustrating a lifting mechanism of the feeding device.

As illustrated in FIG. 4, the lifting mechanism 110 includes a lifting motor 111, a pulley 112, a timing belt 114, a wire 113, a fixed pulley, and so forth. When the lifting motor 111 is rotationally driven in the forward direction (clockwise) by the control of the controller 60, the drive is transmitted to the pulley 112 via the timing belt 114, the wire 113 wound on the fixed pulley is wound on the winding portion by the pulley 112, and the loading portion 72 is raised. By contrast, when the lifting motor 111 is rotationally driven in the reverse direction (counterclockwise) by the control of the controller 60, the drive is transmitted to the pulley 112 via the timing belt 114, the winding of the wire 113 is released by the pulley 112, and the loading portion 72 is lowered.

The installation position (position in the height direction) of the height sensor 62 as the sheet detector is determined from the levitation property by the blower devices 76 and 79 and the suction property by the suction device 95 so that the uppermost sheet P1 can be suctioned and conveyed by the conveying belt 91. In the present embodiment of this disclosure, the height sensor 62 is a reflection-type photosensor and is disposed facing a sheet P (a sheet P accommodated in the sheet container 71) via a light transmitting portion (window portion) formed in the reference fence 73.

With reference to FIG. 2, the position of the end fence 74 in the sheet feeding direction (the interval between the end fence 74 and the reference fence 73) is manually (or automatically) movable according to the size of the sheet P in the sheet feeding direction (in a left-and-right direction in FIG. 2). The distance between the side fences 75 in a width direction of the sheet P can be manually (or automatically) changed according to the size of the sheet P in the width direction (i.e., a direction perpendicular to the sheet feeding direction and vertical to the plane on which FIG. 2 is drawn). The end fence 74 is provided with the blower device 76 (as a second blower device) that blows air from a lateral side toward the uppermost sheet P loaded on the loading portion 72 to float the sheet P in synchronization with the air blowing timing of the blower device 79 (as a first blower device) described below. The blower device 76 (as the second blower device) has substantially the same configuration as the blower device 79 (as the first blower device) described later, except that the installation position is different. After the sheet P (the sheet bundle) has been loaded on the loading portion 72 so that the sheet P abuts against the reference fence 73, the side fence 75 and the end fence 74 are moved to abut against the sheet P (the sheet bundle) loaded on the loading portion 72. Thus, the setting of the sheet P (the sheet bundle) in the sheet container 71 is completed.

On the upper portion of the sheet container 71, the regulating plate 80 is provided on the upper part of the reference fence 73. The regulating plate 80 stands upwardly from the reference fence 73. The regulating plate 80 regulates movement of a subsequent sheet P2 in the sheet feeding direction. The subsequent sheet P2 is a sheet placed below and other than the uppermost sheet P1 that is floated by the blower device 79 (specifically, the air blown from a first blower nozzle 79*a*). That is, the regulating plate 80 prevents a failure that the subsequent sheet P2, which is not supposed to be attracted and conveyed by the conveying belt 91, is misfed (multi-fed) together with the uppermost sheet P1, which is supposed to be attracted and conveyed by the conveying belt 91. Specifically, when the subsequent sheet P2 below the uppermost sheet P1 is about to be fed together with the uppermost sheet P1, the regulating plate 80 interferes with the subsequent sheet P2 to regulate the movement (feeding) of the subsequent sheet P2 in the sheet conveyance direction.

As illustrated in FIGS. 2 and 3, the blower device 79 (as the first blower device) is installed on the downstream side in the sheet feeding direction (the left side of FIG. 2 and FIGS. 3A to 3D) relative to the loading portion 72 (the sheet container 71). The blower device 79 blows air toward the uppermost sheet P1 placed on top of the sheet bundle loaded on the loading portion 72, so as to float the uppermost sheet P1 (as illustrated in FIG. 3B). Specifically, the blower device 79 includes a blower fan, an air duct, the first blower nozzle 79*a*, a second blower nozzle 79*b*, and a plurality of shutters that respectively open and close the first blower nozzle 79*a* and the second blower nozzle 79*b*, separately. The air drawn by the blower fan is blown from the first blower nozzle 79*a* via the air duct. The air is then blown to the uppermost sheet P1 (and the subsequent sheet P2 that lies below the uppermost sheet P1 in the sheet bundle). Consequently, the uppermost sheet P1 is separated from the sheet bundle due to positive air pressure to float the uppermost sheet P1 above the sheet bundle. Since the suction device 95 sucks air above the sheet bundle, the uppermost sheet P1 is facilitated to be drawn toward the conveying belt 91. It is to be noted that a timing at which the blower device 79 blows air through the first blower nozzle 79*a* toward the uppermost sheet P1 is preferably at the same time as or earlier than a timing at which the suction device 95 starts an air suction operation.

Figure 3A:
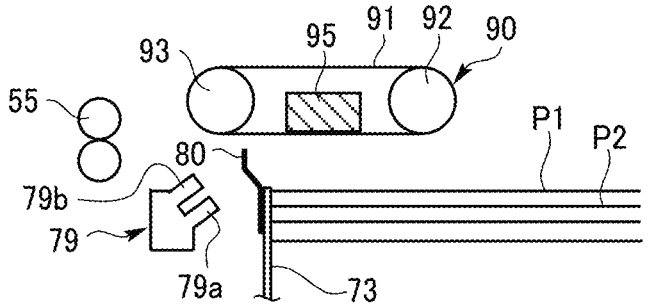
FIGS. 3A, 3B, 3C, and 3D are schematic views illustrating a feeding operation of the feeding device.
Figure 3B:
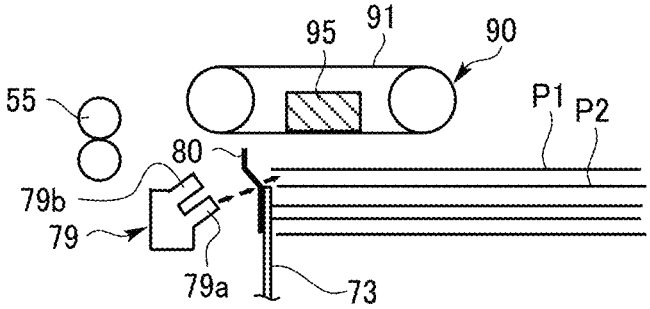
Figure 3C:
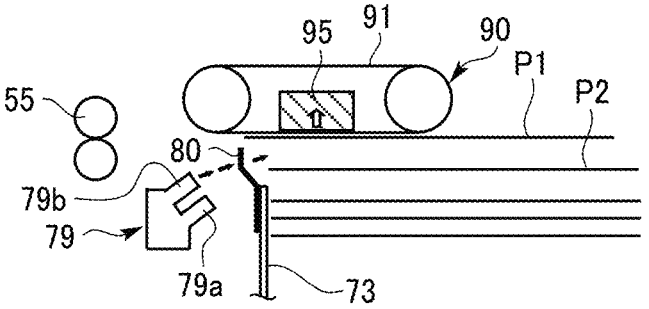

As described above, the blower device 79 according to the present embodiment of this disclosure includes the second blower nozzle 79*b* disposed downstream from the loading portion 72 (the sheet container 71) in the sheet feeding direction. The second blower nozzle 79*b* blows air between the uppermost sheet P1 floated by the first blower nozzle 79*a* and the subsequent sheet P2 below the uppermost sheet P1, so as to separate the subsequent sheet P2 from the uppermost sheet P1. Specifically, the blower device 79 includes a first shutter to open and close the first blower nozzle 79*a* and a second shutter to open and close the second blower nozzle 79*b*. The opening and closing operation of the first shutter and the opening and closing operation of the second shutter are controlled as follows. The blower device 79 blows air toward the uppermost sheet P1 to float the uppermost sheet P1 when the first blower nozzle 79*a* is opened and the second blower nozzle 79*b* is closed, as illustrated in FIG. 3B. By contrast, the blower device 79 blows air between the uppermost sheet P1 and the subsequent sheet P2 to separate the subsequent sheet P2 form the uppermost sheet P1 when the first blower nozzle 79*a* is closed and the second blower nozzle 79*b* is opened, as illustrated in FIG. 3C.

With reference to FIGS. 2, 3A to 3D, and so forth, the suction device 95 is disposed above the loading portion 72 (the sheet container 71). The suction device 95 sucks (attracts) the uppermost sheet P1 that is floated in the air by the blower devices 76 and 79. Specifically, the suction device 95 generates negative air pressure above the sheet bundle loaded on the loading portion 72 so as to draw (attract) the uppermost sheet P1. For details, the suction device 95 includes a suction fan, a suction duct, a suction chamber, and so forth. The suction chamber is disposed inside a loop of the conveying belt 91 and has an opening formed in a bottom portion. The suction chamber communicates through the opening with a spaced portion below via multiple small diameter openings formed in the conveying belt 91. At least one of the plurality of small-diameter openings of the conveying belt 91, formed at one end side in the width direction of the suction chamber is connected to the suction fan via the suction duct. As the suction fan is driven and rotated, air is drawn from the bottom portion of the conveying belt 91 as indicated by white arrow illustrated in FIG. 2.

With reference to FIGS. 2, 3A to 3D, and so forth, the conveying belt 91 as the conveyor conveys the sheet P1 in the sheet feeding direction in a state where the sheet (the uppermost sheet P1) is attracted to the conveying belt 91 by suction of the suction device 95. For details, the conveying belt 91 (conveyor) is disposed to extend over an outlet port of the feeding device 70 at the extreme downstream side in the sheet feeding direction above the sheet container 71. The conveying belt 91 is extended and supported by the two rollers (i.e., the driven roller 92 and the drive roller 93). As the drive roller 93 is driven by a drive motor, the conveying belt 91 is rotated (traveled) in a clockwise direction as illustrated in FIG. 2. The conveying belt 91 has a plurality of small-diameter openings over the whole surface.

Figure 3D:
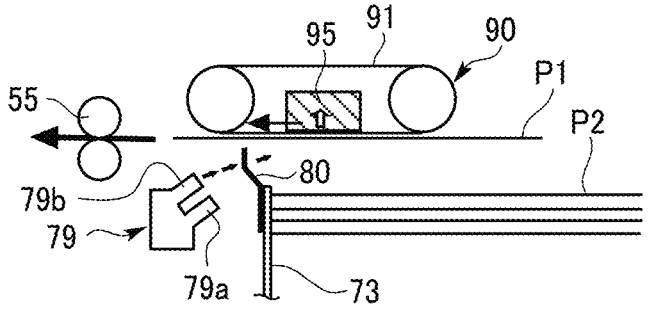

A normal operation of the feeding device 70 according to the present embodiment of this disclosure is described below with reference to FIGS. 3A to 3D. As illustrated in FIG. 3A, a full set of sheets including the uppermost sheet P1 and the subsequent sheet P2 is loaded on the loading portion 72 (the sheet container 71). When a user presses the copy button of the image forming apparatus 1, the first blower nozzle 79*a* of the blower device 79 (and the second blower device 76) blows air toward the uppermost sheet P1, so that the uppermost sheet P1 is floated toward the conveying device 90, as illustrated in FIG. 3B. At the substantially same time, the suction device 95 starts the air suction operation, and the uppermost sheet P1 is attracted to the conveying belt 91, as illustrated in FIG. 3C. It is to be noted that, when the blower device 79 blows air to the uppermost sheet P1 in a state illustrated in FIG. 3B, the subsequent sheet P2 is slightly floated together with the uppermost sheet P1. Thereafter, as illustrated in FIG. 3C, air is blown from the second blower nozzle 79*b* of the blower device 79 (and the blower device 76) between the uppermost sheet P1 and the subsequent sheet P2. The blown air separates the subsequent sheet P2 from the uppermost sheet P1, and the subsequent sheet P2 separated from the uppermost sheet P1 falls onto the loading portion 72. Then, as illustrated in FIG. 3D, the conveying belt 91 starts rotating (moving) in a direction indicated by arrow depicted in the loop of the conveying belt 91 in FIG. 3D. With this rotation of the conveying belt 91, the uppermost sheet P1 attracted to the conveying belt 91 is conveyed (fed) toward the pair of conveying rollers 55. At this time, even when the subsequent sheet P2 is about to be multi-fed together with the uppermost sheet P1, the subsequent sheet P2 placed below the uppermost sheet P1 is regulated by the regulating plate 80. According to this configuration, the feeding failure such as no-sheet feeding (paper jam) and a multi feed does not occur. Then, the uppermost sheet P1 is conveyed in the sheet conveyance direction as indicated by arrow illustrated in FIG. 3D. After a trailing end of the uppermost sheet P1 has passed below the suction device 95, the operations illustrated in FIGS. 3B through 3D are repeated on the subsequent sheet P2 that has turned to another uppermost sheet.

A configuration and operation of the feeding device 70 according to the present embodiment of this disclosure are described below. As described above with reference to FIG. 4 and so forth, the feeding device 70 in the present embodiment includes the lifting mechanism 110 to lift up and down the loading portion 72 that can stack a plurality of sheets P. The feeding device 70 includes a conveying unit (conveyor) that conveys a sheet P loaded on the loading portion 72. The conveying unit includes the blower devices 76 and 79, the suction device 95, the conveying device 90, and so forth. The blower devices 76 and 79 blow air toward the sheet P loaded on the loading portion 72. The suction device 95 is disposed above the loading portion 72 and draws the sheet P floated by the blower devices 76 and 79. The conveying device 90 conveys the sheet P in the sheet feeding direction while drawn by the suction device 95 in a state in which the sheet P is adsorbed.

Here, referring to FIG. 4, the feeding device 70 according to the present embodiment includes the height sensor 62 as a sheet detector, a photosensor 64 as a sheet count detector, and a first counter 85 as a near-end detector.

The height sensor 62 functions as a sheet detector that can detect the presence of sheet P loaded on the loading portion 72 at a specified height position (the position illustrated in FIG. 4). For details, the height sensor 62 (as the sheet detector) is a reflective photosensor and optically detects the presence or absence of the sheet P via the light transmissive portion (window portion) formed on the reference fence 73. Specifically, the height sensor 62 detects whether the sheet P is present ("sheet presence") or not present ("sheet absence") at the position by distinguishing whether the light emitted from a light emitting element is received by a light receiving element as a reflected light. The height position at which the height sensor 62 is installed is the position at which the sheet P (which is the sheet detected as "sheet presence") at the height position is floated by the blower devices 76 and 79 and sufficiently drawn and attracted onto the conveying belt 91 by the suction device 95. That is, the height sensor 62 is used to adjust the height position of the loading portion 72 so that the uppermost sheet P1 loaded on the loading portion 72 is floated by the blower devices 76 and 79 and drawn and attracted onto the conveying belt 91 by the suction device 95. Specifically, a suction range Z (see FIG. 6) is located below the lower end face of the conveying belt 91 (the conveying device 90). In the suction range Z, the sheet P is floated by the blower devices 76 and 79, and can be drawn and attracted onto the conveying belt 91 by the suction device 95. The height sensor 62 is disposed in the suction range Z.

Then, in the normal state (when a sufficient number of sheets P are stacked on the loading portion 72 and the near-end state is not detected), the lifting mechanism 110 is controlled based on the detection result of the height sensor 62 (as the sheet detector). Specifically, when the light emitted from the light emitting element of the height sensor 62 goes straight ahead and is not received by the light receiving element as reflected light, the loading portion 72 is raised by a specified height M (1 mm in the present embodiment) by the control of the lifting mechanism 110 (or the lifting motor 111) by the controller 60, assuming that the sheet P loaded on the loading portion 72 does not reach the height position of the height sensor 62. Such a control is continued until the light emitted from the light emitting element of the height sensor 62 is reflected at the end face of the sheet P (sheet bundle) and received by the light receiving element as reflected light (in other words, until the sheet P loaded on the loading portion 72 reaches the height position of the height sensor 62). With such control, each time the sheet P loaded on the loading portion 72 is fed and the number of loaded sheets gradually decreases, the loading portion 72 is raised by that amount.

The photosensor 64 functions as a sheet count detector capable of directly detecting the number of sheets P conveyed by the conveying unit (or the conveying device 90). As described above, the conveying unit includes the blower devices 76 and 79, the suction device 95, and the conveying device 90. For details, the photosensor 64 (sheet count detector) is disposed in the vicinity of the conveying device 90 and downstream from the conveying device 90 in the sheet feeding direction, and is a reflective photosensor that optically detects the sheet P conveyed by the conveying device 90. The photosensor 64 optically detects the front and rear ends of the sheet P passing through the position the photosensor 64 to detect the sheet P conveyed by the conveying device 90. Specifically, each time a sheet P passing through the position is detected by the photosensor 64, the number of sheets fed is counted by a second counter 86 (see FIG. 4). Therefore, the second counter 86 also functions as a sheet count detector.

In the present embodiment of this disclosure, the photosensor 64 is used as the sheet count detector. However, a counter may be used as the sheet count detector to count the number (the number of times of feeding) that the conveying device 90 is driven. Specifically, the conveying device 90 is configured so that the drive is turned on and off each time the sheet P is conveyed. Therefore, the number of sheets P conveyed by the conveying device 90 can be indirectly detected by counting the on and off times of the motor 97 that drives the conveying device 90 (drive roller 93) by the second counter 86.

The first counter 85 functions as a near-end detector capable of indirectly detecting the near-end state in which the stack height H of sheets P loaded on the loading portion 72 is a specified value H3 or less. Note that the "stack height H" of sheets P is substantially equal to H=N×R if the number of stacked sheets P is N and the thickness R of the stacked sheets P are all the same.

For details, the first counter 85 (as the near-end detector) is a counter that can count the number of pulses of the lifting motor 111 of the lifting mechanism 110. Since the lifting motor 111 is a stepping motor, counting the number of pulses of the lifting motor 111 with the first counter 85 allows the amount of rising and lowering movement of the loading portion 72 to be grasped and the height of the loading portion 72 to be detected. Specifically, when the loading portion 72 is raised by an amount, the number of pulses increases by the amount, and when the loading portion 72 is lowered by an amount, the number of pulses decreases by the amount. When the state in which the loading portion 72 has reached the predetermined height position (which is the position illustrated in FIG. 6A) is detected by the first counter 85, the loading height of the sheet P loaded on the loading portion 72 is in the state in which the loading height has reached the specified value H3 (near-end state). This "near-end state" is a condition in which the number of sheets P stacked on the loading portion 72 is small (in other words, the stack height H is low). If the feeding of sheets P is continued thereafter, the sheets P on the loading portion 72 run out relatively quickly. Therefore, when the near-end state is detected by the first counter 85, the fact is displayed on the operation display panel 100 (see FIG. 1). Such indications include, for example, "The feeding device is running low on sheets".

Moreover, this "near-end state" is a condition in which the height sensor 62 (sheet detector) is difficult to detect the presence or absence of the sheet P, and the control of the lifting mechanism 110 based on the detection result of the height sensor 62 as described above cannot be sufficiently performed. For details, when the stack height H is lower, the height (width) of the end face of the sheets P (sheet bundle) is smaller, even in the state of "sheet presence", the height sensor 62 is likely to falsely detect as the state of "sheet absence". In such a case, it is possible to perform a pre-conveyance, measure the height at which a false detection occurs, and set the specified value H3 (height at the near-end state) in advance. However, a lot of time and effort are required. Further, when the stack height H is lower, the loading portion 72 approaches the height position of the height sensor 62, and the light emitted from the height sensor 62 is reflected by the end face of the loading portion 72 and received as reflected light. As a result, a false detection is likely to occur. If the lifting mechanism 110 cannot be controlled due to such a false detection of the height sensor 62, the feeding failure that the sheet P cannot be fed will occur even though the sheet P is still present on the loading portion 72.

Figure 7A:
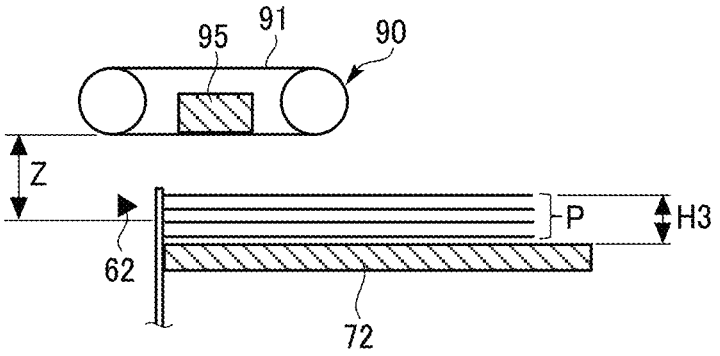
FIGS. 7A and 7B are schematic views illustrating an operation of the loading portion in the near-end state in a comparative example of the feeding device.
Figure 7B:
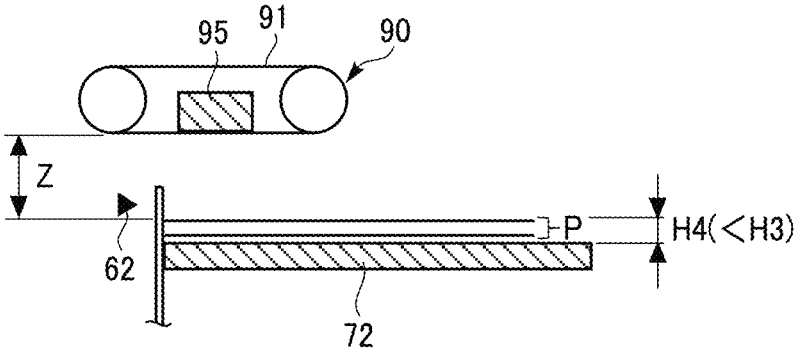

More specifically, as illustrated in FIG. 7A, if the lifting control of the loading portion 72 is performed with the height sensor 62 even after the stack height of sheets P on the loading portion 72 reaches the specified value H3 and the loading portion 72 is in the near-end state, the height sensor 62 may falsely detect the "sheet presence" even if the stack height of sheets P on the loading portion is a stack height H4, which is lower than the stack height H3 at the near-end state, as illustrated in FIG. 7B. In such a case, as illustrated in FIG. 7B, the uppermost sheet P is out of the suction range Z, and cannot be floated by the blower devices 76 and 79 and drawn by the suction device 95. As a result, the sheet P cannot be fed by the conveying device 90 (feeding failure occurs).

In order to reduce such failure, the following control is performed in the present embodiment. First, until the near-end state is detected by the first counter 85 (as the near-end detector), the controller 60 controls the lifting mechanism 110 based on the detection result of the height sensor 62 (as the sheet detector). For details, until the near-end state is detected by the first counter 85 (near-end detector), the controller 60 controls the lifting mechanism 110 (or the lifting motor 111) so as to raise the loading portion 72 by the specified height M when the detection result of the height sensor 62 (sheet detector) changes from "sheet presence" to "sheet absence". This is because the stack height H of sheets P stacked on the loading portion 72 is sufficiently high until the near-end state is detected, and the false detection by the height sensor 62 as described above is unlikely to occur.

Figure 5A:
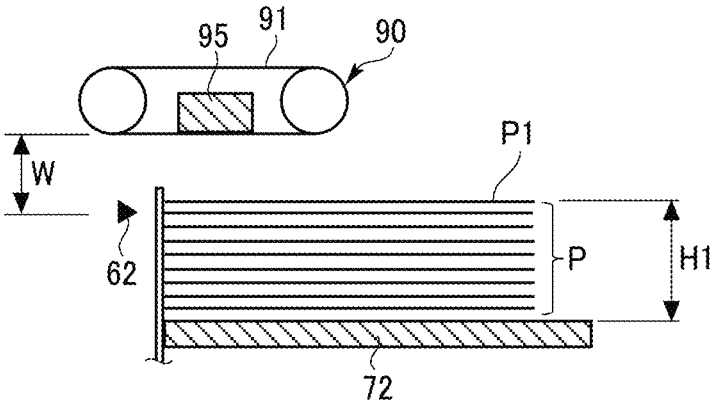
FIGS. 5A, 5B, and 5C are schematic views illustrating lifting control of a loading portion until a near-end state is detected, according to an embodiment of the present disclosure.
Figure 5B:
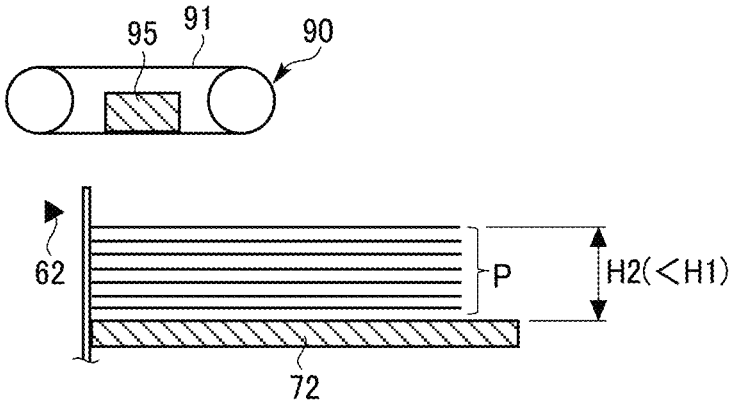
Figure 5C:
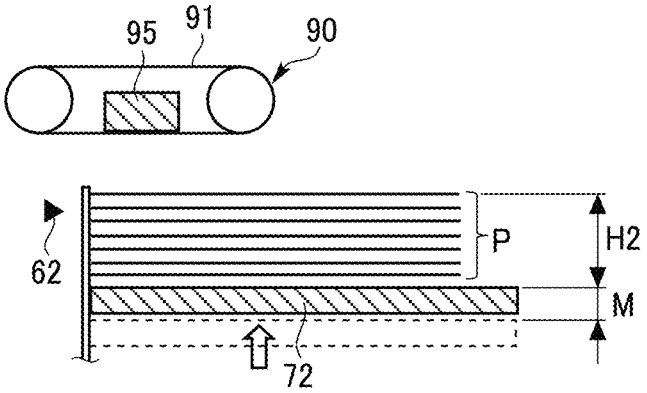

More specifically, as illustrated in FIG. 5A, when the stack height H1 of sheets P on the loading portion 72 is sufficiently high (in other words, when the position is not in the near-end state), the stack height of sheets P on the loading portion 72 is eventually lowered to H2 (<H1) as illustrated in FIG. 5B due to the sheet feeding operation of the feeding device 70, and the height sensor 62 detects the "sheet absence". When the "sheet absence" is detected, as illustrated in FIG. 5C, the loading portion 72 is raised in the direction indicated by white arrow by the specified height M. The lifting control based on the detection result of the height sensor 62 continues until the near-end state is detected.

On the other hand, after the near-end state is detected by the first counter 85 (as the near-end detector), the lifting mechanism 110 is controlled based on the detection result of the photosensor 64 (as the sheet count detector). For details, after the near-end state is detected by the first counter 85 (as the near-end detector), the lifting mechanism 110 (or the lifting motor 111) is controlled so as to raise the loading portion 72 by a specified height M' each time the detection result of the photosensor 64 (sheet count detector) reaches a specified number X of sheets. In other words, after the near-end state is detected, the lifting control with the first counter 85 (as the near-end detector) is not performed and is switched to the lifting control with the photosensor 64 (as the sheet count detector). The feeding number of sheets in the conveying device 90 is cumulatively counted by the second counter 86 every time the sheet P is fed. When the cumulative feeding number of sheets reaches the specified number X of sheets, the feeding number of sheets in the conveying device 90 is reset. By controlling as described above, even if the stack height H of sheets P stacked on the loading portion 72 is low from the detection of the near-end state until the sheets P on the loading portion 72 run out, the lifting control of the loading portion 72 can be performed so that the loading portion 32 is at a height position where the levitation property by the blower devices 76 and 79 and the suction property by the suction device 95 can be ensured.

Figure 6A:
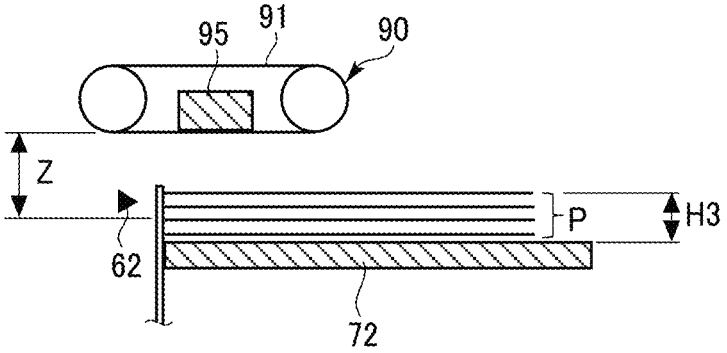
FIGS. 6A, 6B, and 6C are schematic views illustrating lifting control of the loading portion after the near-end state is detected.
Figure 6B:
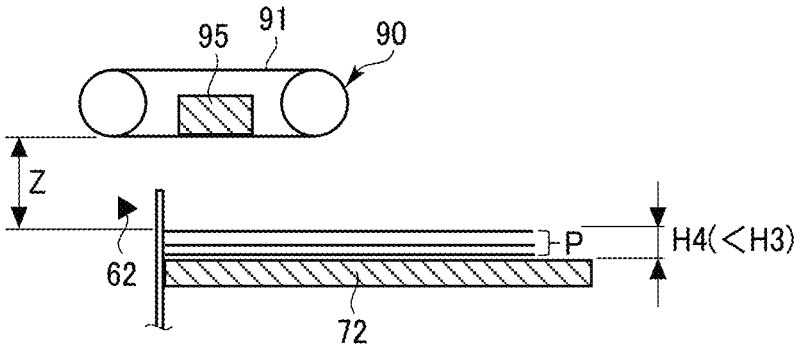
Figure 6C:
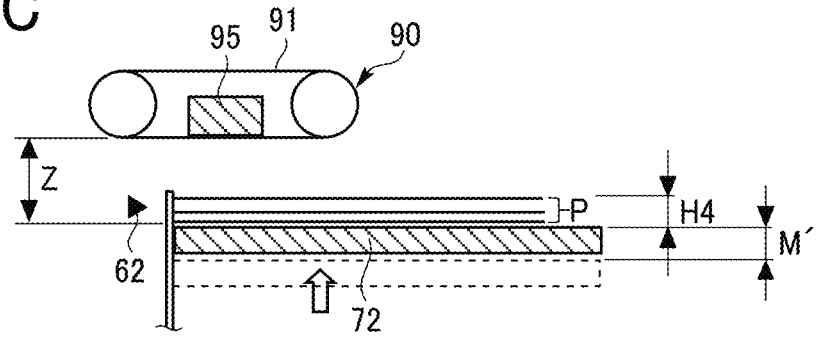

More specifically, as illustrated in FIG. 6A, when the stack height of sheets P on the loading portion 72 reaches a specified value H3 and the near-end state is detected, the stack height of sheets P on the loading portion 72 is lowered to H4 (<H3) as illustrated in FIG. 6B due to the sheet feeding operation of the feeding device 70 thereafter. However, the condition can be grasped by the photosensor 64 (sheet count detector) that detects the number of sheets fed by the sheet feeding operation. Therefore, when the state as illustrated in FIG. 6B is directly detected by the photosensor 64, as illustrated in FIG. 6C, the loading portion 72 is raised in the direction indicated by white arrow by the specified height M'. The lifting control based on the feeding number of sheets is continued until the sheets P stacked on the loading portion 72 run out. The state in which the sheet P loaded on the loading portion 72 is empty (end state) is detected by an end sensor.

Here, in the present embodiment, the specified height M' by which the loading portion 72 is raised and lowered by the lifting control based on the photosensor 64 (as the sheet count detector) is matched with the specified height M by which the loading portion 72 is raised and lowered by the lifting control based on the first counter 85 (as the near-end detector) (M'=M). That is, the height M' by which the loading portion 72 is raised each time the detection result of the photosensor 64 (sheet count detector) reaches the specified number of sheets is set to be the same as the height M by which the loading portion 72 is raised when the detection result of the height sensor 62 (as the sheet detector) changes from "sheet presence" to "sheet absence". Such a configuration can simplify the control of the lifting mechanism 110 and ensure the levitation property by the blower devices 76 and 79 and the suction property by the suction device 95 even in the near-end state.

Figure 8:
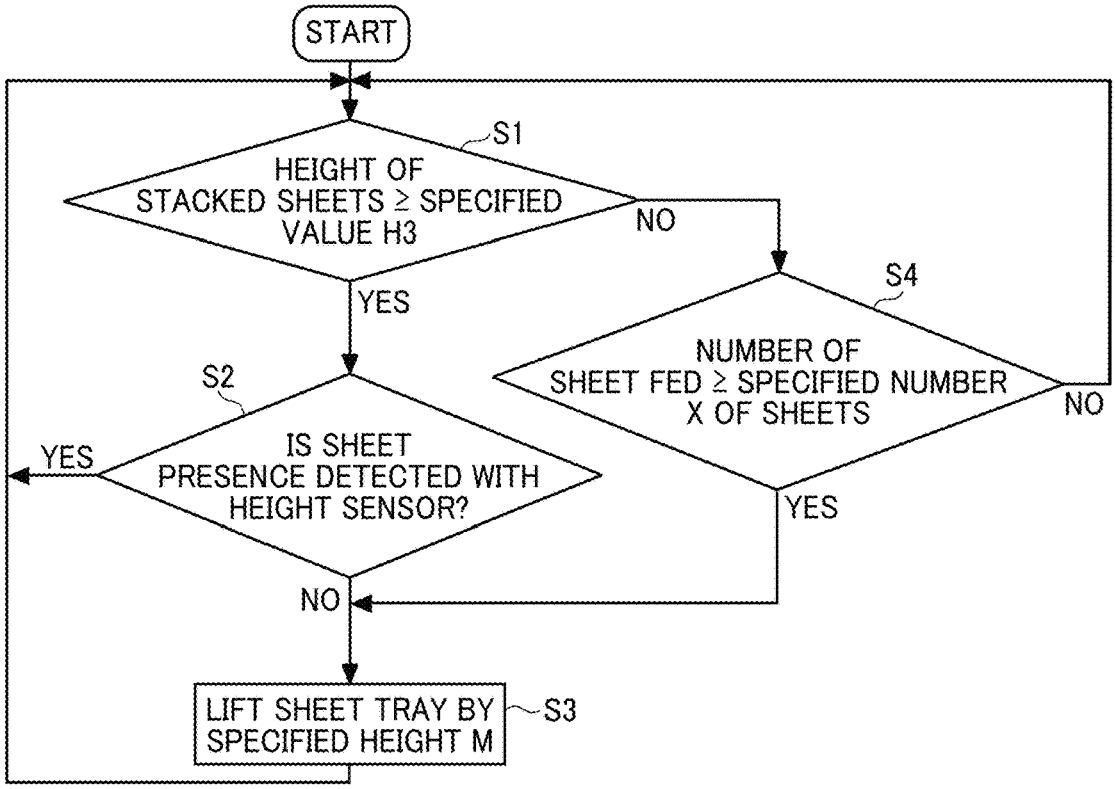
FIG. 8 is a flowchart illustrating control of the lifting mechanism, according to an embodiment of the present disclosure.

FIG. 8 is a flowchart illustrating an example of the control of the lifting mechanism 110 according to the present embodiment. As illustrated in FIG. 8, first, based on the detection result of the first counter 85 (as the near-end detector), the controller 60 determines whether the stack height H of sheets P stacked on the loading portion 72 is the specified value H3 or more (step S1). As a result, when the controller 60 determines that the stack height H is the specified value H3 or more, the controller 60 determines whether the height sensor 62 detects "sheet presence" as not in the near-end state (step S2). Then, as a result, when the "sheet presence" is not detected, the controller 60 controls the lifting motor 111 to raise the loading portion 72 to the specified height M (step S3). By contrast, when "sheet presence" is detected in step S2, the flow from step S1 onward is repeated as it is. On the other hand, when the controller 60 determines that the stack height H is less than the specified value H3 in step S1, the controller 60 determines as the near-end state and determines whether the feeding number of sheets detected by the photosensor 64 reaches the specified number X (e.g., five sheets) (step S4). As a result, when the feeding number of sheets reaches the specified number X, the controller 60 controls the lifting motor 111 to raise the loading portion 72 by the specified height M (step S3). By contrast, when the feeding number of sheets does not reach the specified number X in step S4, then the flow from step S1 (or step S4) onward is repeated.

Here, in the present embodiment, the operation display panel 100 (see FIG. 1) as a thickness detector is disposed to indirectly detect the thickness (sheet thickness) of sheets P stacked on the loading portion 72. For details, the controller 60 grasps the thickness of the sheet P based on the information about the sheet P input to the operation display panel 100 by the user. In the present embodiment, the specified number X can be set based on the thickness detected by the operation display panel 100 (as the thickness detector). Specifically, when the thickness detected by the operation display panel 100 (as the thickness detector) is thick, the specified number X (which is a control value used in the lifting control based on the number of sheets fed after near-end detection) can be adjusted and controlled to be smaller than when the thickness detected by the operation display panel 100 is thin. The reason for such control is that, assuming that the number of sheets fed is constant, the amount of decrease in the stack height H of sheets P stacked on the loading portion 72 is larger in the case of a thicker sheet than in the case of a thinner sheet. Such control allows the lifting control of the loading portion 72 after the near-end detection to be performed with high accuracy. Such control may be performed using a thickness sensor (e.g., a thickness sensor, such as a distance sensor, which is located on the downstream side of the conveying device 90) that directly detects the thickness of sheets P (sheet thickness) loaded on the loading portion 72.

First Variation

Figure 9:
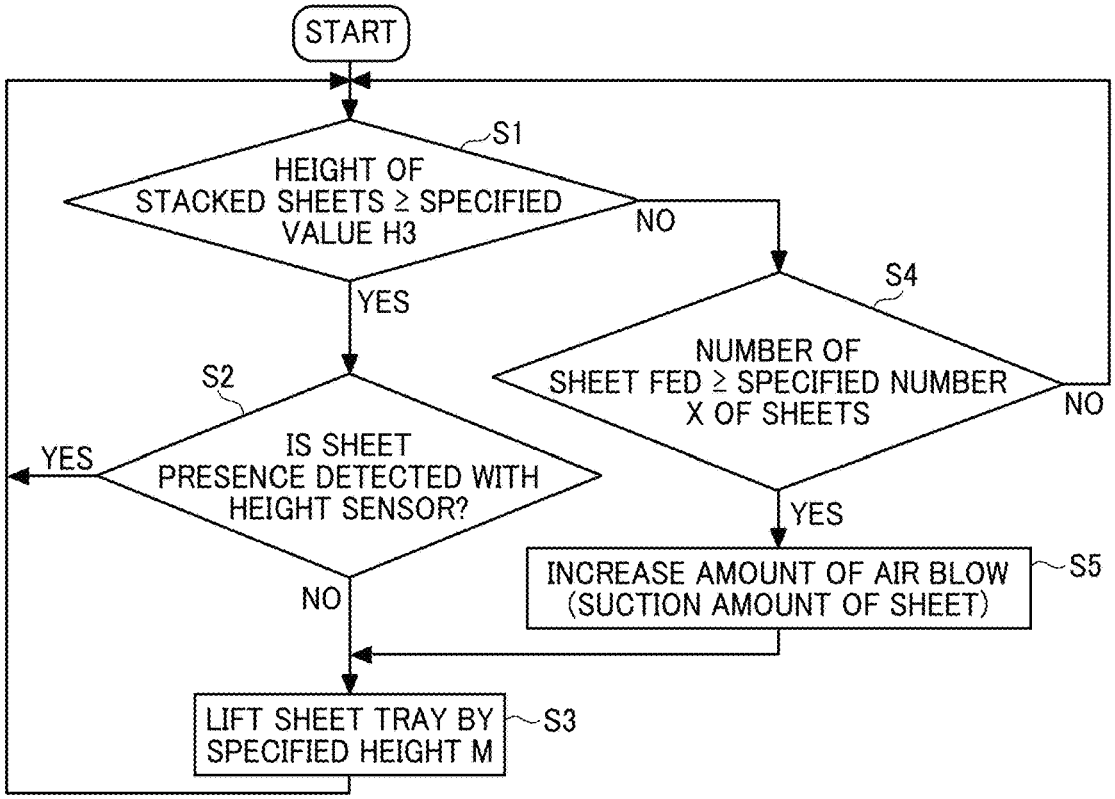
FIG. 9 is a flowchart illustrating control of the lifting mechanism according to a first variation.

FIG. 9 is a flowchart illustrating the control of the lifting mechanism 110 in the first variation. In FIG. 9, step S5 is added to the process flow of FIG. 8. In the first variation, the blower devices 76 and 79 are adjusted and controlled so that the blowing amount of air per unit time is larger after the near-end state is detected by the first counter 85 (as the near-end detector) than before the near-end state is detected by the first counter 85. Specifically, when the controller 60 determines that the feeding number of sheets reaches the specified number X of sheets in step S2 of FIG. 9 after the near-end detection, the controller 60 controls the blower devices 76 and 79 to increase the rotational speed of blower fans. This is because, in the near-end state, the loading portion 72 might be raised to the vicinity of the blower devices 76 and 79, interfere with the air blown onto the sheet P, and weaken the air blown by the blower devices 76 and 79. Such control can prevent a failure that the levitation property of the sheet P is lowered by the blower devices 76 and 79 after the near-end detection. In the first variation, the suction device 95 is adjusted and controlled so that the suction amount of air per unit time is larger after the near-end state is detected by the first counter 85 (as the near-end detector) than before the near-end state is detected by the first counter 85. Specifically, when the controller 60 determines that the feeding number of sheets reaches the specified number X of sheets in step S4 of FIG. 9 after the near-end detection, the controller 60 controls the suction device 95 to increase the rotational speed of suction fans. As described above, this is as because the levitation of the sheet P might decrease by the blower devices 76 and 79 in the near-end state. Therefore, the suction property of the suction device 95 is enhanced to compensate for such a decrease in the levitation of the sheet P.

Second Variation

Figure 10A:
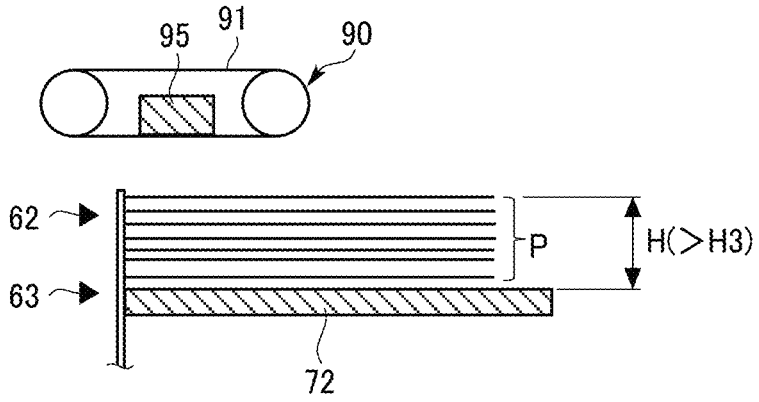
FIGS. 10A and 10B are schematic views illustrating an operation of the feeding device according to a second variation.
Figure 10B:
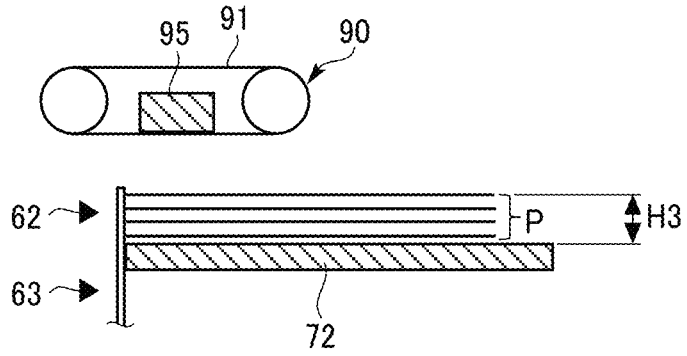

In the feeding device 70 of the second variation, a detector that can directly detect the near-end state in which the stack height H of sheets P stacked on the loading portion 72 is the specified value H3 or less is used as a near-end detector that detects the near-end state. For details, as illustrated in FIGS. 10A and 10B, a plurality of photosensors 62 and 63 (in other words, the height sensor 62 as a first sensor and a second sensor 63 as a second sensor) capable of detecting the presence or absence of sheets P loaded on the loading portion 72 are arranged side by side at intervals in the height direction. The plurality of photosensors 62 and 63 are used as near-end detectors. Each of these plurality of photosensors 62 and 63 is a reflective photosensor, and the photosensor arranged at the uppermost position also functions as the height sensor 62 described in FIG. 5 and so forth. As illustrated in FIG. 10A, when the sheet P (or the loading portion 72) is detected by the two photosensors 62 and 63, it is not in the near end state. As illustrated in FIG. 10B, when the sheet P (or the loading portion 72) is detected by the height sensor 62 as the first sensor of the two photosensors, and when neither the sheet P nor the loading portion 72 is detected by the second sensor 63, it is in the near-end state. Even when the near-end detector is configured in this way, the sheet P can be fed well up to the last sheet by switching from the lifting control by the height sensor 62 to the lifting control by the feeding number of sheets after the near-end detection.

As described above, the feeding device 70 according to the present embodiment includes the loading portion 72, the lifting mechanism 110, and the conveying unit including the blower devices 76 and 79, the suction device 95, and the conveying device 90. The loading portion 72 can stack a plurality of sheets P thereon. The lifting mechanism 110 lifts up and down the loading portion 72. The conveying unit including the blower devices 76 and 79, the suction device 95, and the conveying device 90 conveys the sheet P on the loading portion 72. Further, the feeding device 70 of the present embodiment includes the height sensor 62 (as the sheet detector), the photosensor 64 (as the sheet count detector), and the first counter 85 (as the near-end detector). The height sensor 62 can detect the presence or absence of sheets P loaded on the loading portion 72 at the specified height position. The photosensor 64 can detect the feeding number of sheets P conveyed by the conveying unit including the blower devices 76 and 79, the suction device 95, and the conveying device 90. The first counter 85 can detect the near-end state in which the stack height H of sheets P stacked on the loading portion 72 is the specified value H3 or less. Until the near-end state is detected by the first counter 85, the controller 60 controls the lifting mechanism 110 based on the detection result of the height sensor 62. After the near-end state is detected by the first counter 85, the controller 60 controls the lifting mechanism 110 based on the detection result of the photosensor 64. According to this configuration, even if the number of sheets P stacked on the loading portion 72 is reduced, the sheet P can be fed well.

It is to be noted that the present embodiment of this disclosure is applied to the feeding device 70 provided in the image forming apparatus 1 that performs monochrome image formation. However, embodiments of this disclosure are not limited to such a feeding device provided in a monochrome image forming apparatus. For example, a feeding device according to an embodiment of this disclosure can also be provided in an image forming apparatus that performs color image formation. Further, it is to be noted that the present embodiment of this disclosure is applied to the feeding device 70 provided in the image forming apparatus 1 that employs electrophotography. However, embodiments of this disclosure are not limited to such a feeding device in an electrophotographic image forming apparatus. For example, a feeding device according to an embodiment of this disclosure can also be provided in an image forming apparatus that employs an inkjet method or a stencil printing machine. Further, it is to be noted that the present embodiment of this disclosure is applied to the feeding device 70 that can hold the large capacity of sheets. However, embodiments of this disclosure are not limited to such a feeding device for a large capacity of sheets. For example, the upper sheet feed tray 12 and the lower sheet feed tray 13 both may be feeding devices according to an embodiment of this disclosure, as long as the upper sheet feed tray 12 and the lower sheet feed tray 13 employ an air suction method. Further, the document feeder 10 (as an ADF) may be a feeding device according to an embodiment of the present disclosure as long as the document feeder 10 employs an air suction method. In the present embodiment, the "sheet count detector" may be a detector capable of directly detecting the feeding number of sheets P conveyed by the conveying unit including the blower devices 76 and 79, the suction device 95, and the conveying device 90, or a detector capable of indirectly detecting the feeding number of sheets P conveyed by the conveying unit including the blower devices 76 and 79, the suction device 95, and the conveying device 90. In the present embodiment, the "near-end detector" may be a detector capable of directly detecting the near-end state in which the stack height H of sheets P stacked on the loading portion 72 is the specified value H3 or less, or a detector capable of indirectly detecting the near-end state in which the stack height H of sheets P stacked on the loading portion 72 is the specified value H3 or less. In such configurations, advantageous effects equivalent to the above-described effects of the present embodiment are also attained.

Note that embodiments of the present disclosure are not limited to the above-described embodiments and it is apparent that the above-described embodiments can be appropriately modified within the scope of the technical idea of the present disclosure in addition to what is suggested in the above-described embodiments. Further, the number, position, shape, and so on of components are not limited to those of the present embodiment, and may be the number, position, shape, and so on that are suitable for implementing the present invention.

The sheet P in the above-described embodiments of this disclosure is herein defined as any sheet-shaped recording medium, such as general paper, coated paper, label paper, overhead projector (OHP) transparency, metal sheet, or a film sheet.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A feeding device comprising:

a loading portion including a plate configured to stack a plurality of sheets;

a lifting mechanism including a lifting motor, the lifting mechanism configured to lift the plate of the loading portion;

a conveying unit including a sheet conveyor configured to convey the sheets on the loading portion;

a sheet detector including a sensor configured to detect presence or absence of the sheets on the loading portion at a specified height position;

a sheet count detector configured to detect a number of sheets conveyed by the conveying unit;

a near-end detector configured to detect a near-end state in which a stack height of the sheets on the loading portion is a specified value or less; and processing circuitry configured to switch from (i) controlling the lifting mechanism based on a detection result of the sheet detector to (ii) controlling the lifting mechanism based on a detection result of the sheet count detector, in response to detecting the near-end state.

2. The feeding device according to claim 1, further comprising:

a blower device including a fan configured to blow air toward the sheets on the loading portion;

a suction device including a fan configured to draw a sheet floated from the sheets by the blower device; and the sheet conveyor configured to convey the sheet in a feeding direction with the sheet being drawn onto the sheet conveyor by suction of the suction device.

3. The feeding device according to claim 1, wherein the processing circuitry is further configured to:

control the lifting mechanism to raise the loading portion by a first height when the detection result of the sheet detector changes from a state of sheet presence to a state of sheet absence before the near-end state is detected by the near-end detector; and control the lifting mechanism to raise the loading portion by a second height each time the detection result of the sheet count detector reaches a specified number after the near-end state is detected by the near-end detector.

4. The feeding device according to claim 3, wherein the processing circuitry is configured to set the first height and the second height to be same.

5. The feeding device according to claim 1, further comprising:

an operation panel configured to receive input indicating a thickness of the sheets on the loading portion, wherein the processing circuitry is configured to set a value of the specified number based on the thickness.

6. The feeding device according to claim 1, further comprising:

a blower device including a fan configured to blow air toward the sheets on the loading portion, wherein the processing circuitry is configured to control the blower device so that an amount of the air blown per unit time is larger after the near-end state is detected by the near-end detector than before the near-end state is detected by the near-end detector.

7. The feeding device according to claim 1, further comprising:

a suction device including a fan, the suction device being disposed above the loading portion, the suction device being configured to suck the sheets on the loading portion, wherein the processing circuitry is configured to control the suction device so that an amount of suction per unit time is larger after the near-end state is detected by the near-end detector than before the near-end state is detected by the near-end detector.

8. The feeding device according to claim 1, wherein the sheet count detector is a photosensor configured to optically detect the sheets conveyed by the conveying unit.

9. The feeding device according to claim 1, wherein the processing circuitry is configured to perform functions of the sheet count detector by counting a number of times the conveying unit is driven.

10. The feeding device according to claim 1, wherein the processing circuitry is configured to perform functions of the near-end detector by counting a number of pulses of a lifting motor of the lifting mechanism.

11. The feeding device according to claim 1, wherein the near-end detector includes a plurality of photosensors disposed side by side at an interval in a height direction and configured to detect presence or absence of the sheets on the loading portion.

12. The feeding device according to claim 11, wherein the sheet detector is a photosensor disposed at an uppermost position of the plurality of photosensors.

13. An image forming apparatus comprising the feeding device according to claim 1.

14. The feeding device according to claim 1, wherein after switching to controlling the lifting mechanism based on the detection result of the sheet count detector, the processing circuitry is configured to control the loading portion each time the detection result of the sheet count detector indicates that a cumulative number of sheets fed by the feeding device is equal to a set number.

15. The feeding device according to claim 14, wherein after switching to controlling the lifting mechanism based on the detection result of the sheet count detector, the processing circuitry is configured to control the loading portion by raising the loading portion by a set height each time the detection result of the sheet count detector indicates that a cumulative number of sheets fed by the feeding device is equal to the set number.

16. The feeding device according to claim 15, wherein the set height the loading portion is raised when the lifting mechanism is controlled using the sheet count detector is equal to a height that the loading portion rises when the lifting mechanism is controlled based on the detection result of the sheet detector.

* * * * *